US006405373B1

(12) United States Patent
Grau

(10) Patent No.: US 6,405,373 B1
(45) Date of Patent: Jun. 18, 2002

(54) VISOR FOR HELMET, PARTICULARLY A MOTORCYCLE HELMET

(75) Inventor: Werner Grau, Haberskirch (DE)

(73) Assignee: Uvex Sports GmbH & Co. KG, Furth (DE)

( * ) Notice: Subject to any disclaimer, the term of this patent is extended or adjusted under 35 U.S.C. 154(b) by 0 days.

(21) Appl. No.: 09/842,630

(22) Filed: Apr. 27, 2001

(51) Int. Cl.[7] ..... A61F 9/00; A42B 1/08
(52) U.S. Cl. ..... 2/15; 2/424
(58) Field of Search ..... 2/15, 9, 424, 425, 2/6.3, 6.4, 6.5

(56) References Cited

U.S. PATENT DOCUMENTS 4,047,249 A * 9/1977 Booth
5,161,261 A 11/1992 Kamata
5,500,953 A * 3/1996 Reuber et al.
5,671,483 A * 9/1997 Reuber
5,694,650 A * 12/1997 Hong
5,765,235 A * 6/1998 Arnold
5,845,342 A * 12/1998 Park
6,161,225 A * 12/2000 Arai

FOREIGN PATENT DOCUMENTS

EP 0 953 299 A2 3/1999
FR 2 657 348 A1 4/1991

* cited by examiner

*Primary Examiner*—Rodney M. Lindsey
(74) *Attorney, Agent, or Firm*—Browdy and Neimark

(57) ABSTRACT

In a visor for a helmet, particularly a motorcycle helmet, comprising an outer plastic pane and an inner plastic pane which are held spaced apart relative to one another through a sealing edge under inclusion of an air cushion, provision is made, to attain a simple producibility while avoiding frame parts, for the outer pane to be extruded of plastic and to have edge regions that project toward the inside, into which an inner pane that is punched from a flat, plate-shaped plastic material can be inserted in a form-fitting manner.

8 Claims, 2 Drawing Sheets

FIG. 2
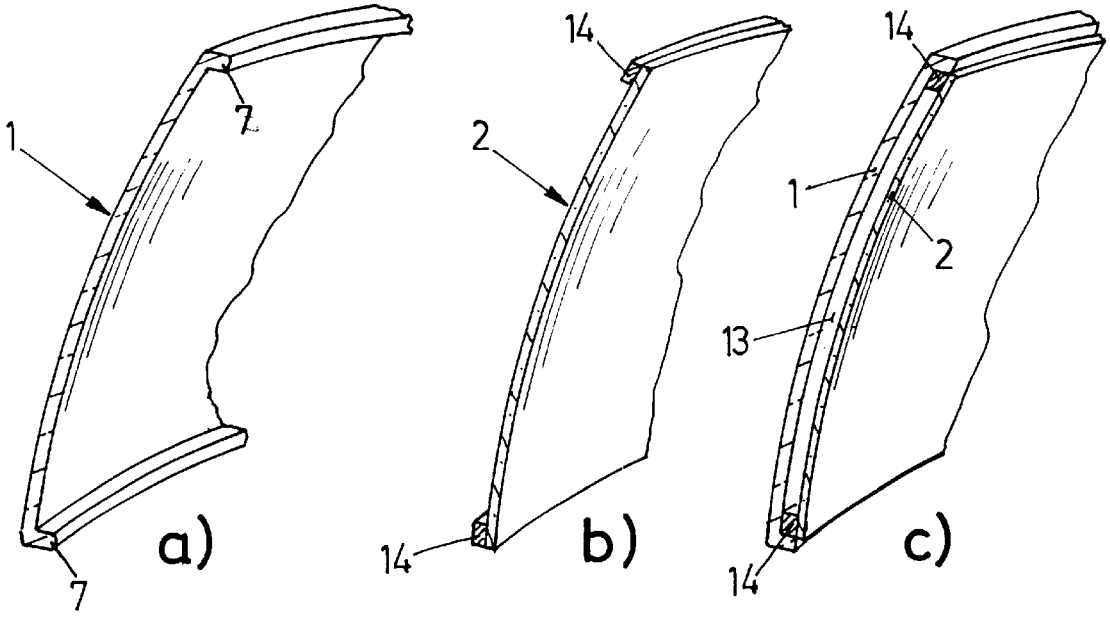
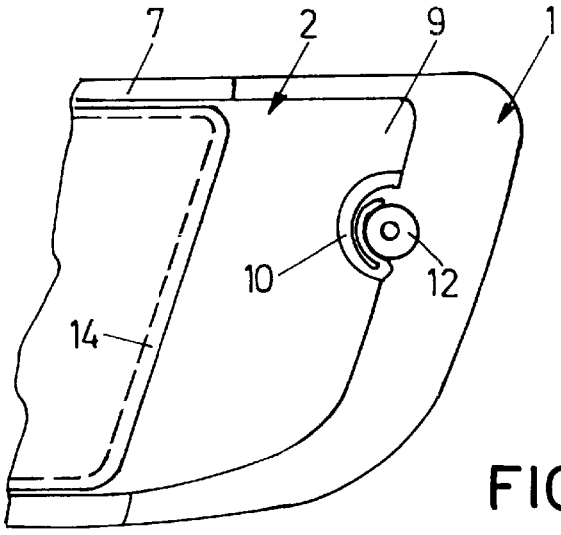
FIG. 3

VISOR FOR HELMET, PARTICULARLY A MOTORCYCLE HELMET

BACKGROUND OF THE INVENTION

1. Field of the Invention

The present invention is concerned with a visor for a helmet, particularly a motorcycle helmet, comprising an outer plastic pane and an inner plastic pane that are held spaced apart relative to one another through a sealing edge under inclusion of an air cushion.

2. Background Art

Known visors of this type comprise a relatively compact frame in which the two panes are fixed. This results in the shortcoming that the visibility is restricted by the lower frame section when the visor is partly open.

SUMMARY OF THE INVENTION

Based on this, the invention is based on the object of designing a visor of the above type in such a way that the shortcomings of conventional designs of this type are avoided and a cost-effective producibility and assembly is ensured while attaining a maximum individual adjustability to the individual desires of the given user.

This object is met according to the invention in such a way that the outer pane is extruded of plastic and has edge regions projecting toward the inside, into which a pane that has been punched out of flat, plate-like plastic material can be inserted in a form-fitting manner. Specifically, provision is made for the inner, punched pane to sit against the outer pane under a pretension that arches the inner pane.

By providing an extruded outer pane, it is possible to first form edge regions that project as one piece with this pane and to fix the inner pane there without requiring a separate frame element for fixing and connecting the panes. This creates particularly favorable visibility conditions in all positions of the visor. The connection or replacement of the inner visor pane to the outer visor pane can be made with a single flick of the wrist and the inner pane nevertheless sits closely against the outer one. A significant advantage lies in the fact that no fixed interconnection is created between the outer and inner panes, so that the user can freely select the inner pane, e.g. regarding its tint, and can optionally also change it retroactively. Since initially only a flat punched-out plate is required as the inner pane, it can be manufactured particularly cost-effectively.

To attain the pre-tension of the inner pane, provision is advantageously made for it to sit with its outer ends against projections on the inside of the outer pane in such a way that the curvature created in this manner has a slightly lesser curvature radius than the outer pane has in this region.

Specifically, the ends of the inner pane may encompass the projections of the outer pane at least partially in a form-fitting manner.

Since, according to the invention, the outer pane is produced by extrusion, it is possible to design the same spherically curved forward, i.e., it may also have a curvature in a vertical sectional plane, which creates particularly favorable visibility conditions and also particularly dynamic optics.

The inner pane may be penetrated by a tint or provided with a tinted coating, as well as with an anti-condensation coating. Anti-condensation coatings of this type may be applied particularly advantageously onto cellulose acetate panes. The outer pane, with an outer coating to increase the scratch-resistance, is composed particularly of polycarbonate.

Regarding the outer pane, provision may, furthermore, advantageously be made for the visor mounting and/or adjustment sections to be extruded as one piece with the pane. It is possible to design these sections in such a way that the inventive visor may also be used to retrofit helmets that used to be equipped with visors with frames.

The mounting and/or adjustment sections are, at the same time, advantageously formed as a catch for the inner pane.

The side of the inner pane that sits against the outer pane is provided with a preferably sprayed-on circumferential silicon seal which, in combination with the elastic forward-curvature of the inner pane, ensures a tight seal of the air cushion between the two panes.

The invention will be explained in further detail below based on a preferred embodiment, in combination with the drawing.

BRIEF DESCRIPTION OF THE DRAWINGS

FIG. 2*a* through *c* shows sectional views of the outer and inner panes prior to joining them and after joining them, and FIG. 3 shows a partial side view of a visor comprising an outer and inner pane.

DESCRIPTION OF THE PREFERRED EMBODIMENT

Figure 1:
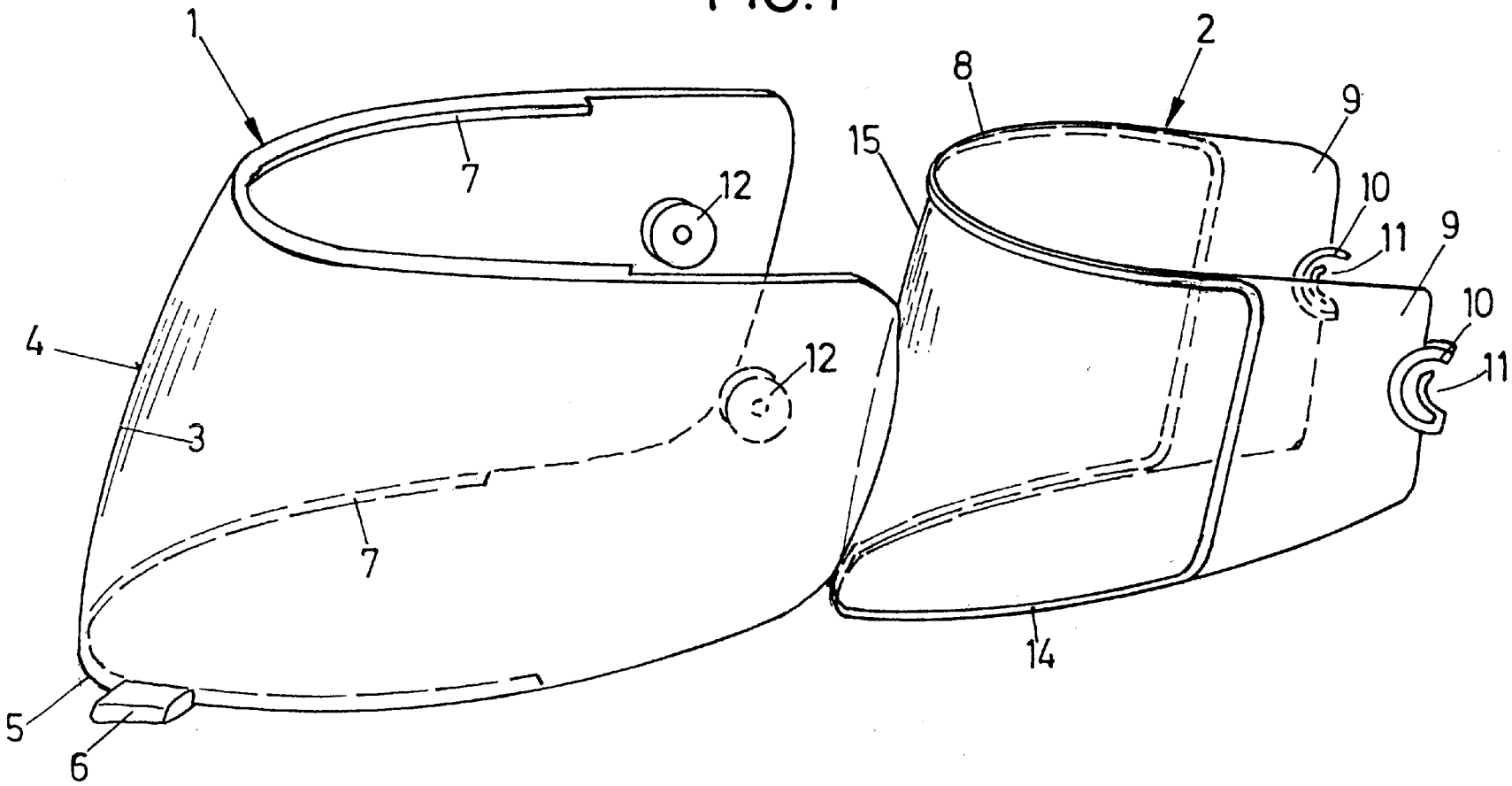
FIG. 1 shows a perspective view of the outer and inner panes prior to inserting the inner pane into the outer pane.

A visor shown in the drawing comprises an outer pane 1 and an inner pane 2.

The outer pane 1 is extruded of polycarbonate and has a spherical curvature 3. An anti-scratch coating 4 is provided on the outside of panel. At the lower edge 5 of the outside there is a projection 6 that serves as a handling aid during opening and closing of the visor.

Edge regions 7 that project toward the inside, which can be seen particularly well in the sectional view according to FIG. 2*a*, extend along the inside of the outer pane 1.

The inner pane 2 is composed of cellulose acetate and is punched from a plate-shaped base material and can be provided with an anti-condensation coating 15.

The outer contour 8 of the inner pane is shaped and dimensioned such that the inner pane 2 can be fixed on the inside of the outer pane 1 in a form-fitting manner, i.e., the projecting edge regions 7 of the outer pane 1 encompass the inner pane at least to the extent that it is fixed in a form-fitting manner.

This position is locked-in in such a way that shoulders 10 with cut-outs 11 are provided in the region of the rear ends 9 of the inner pane 2, which encompass the inward projections 12 on the inside of the outer pane 1 in a formfitting manner. The projections 12 are extruded as one piece with the outer pane 1 and can simultaneously also serve as mounting and/or adjustment sections for the pane on the helmet.

The spacing of the cutouts 11 in the circumferential direction is somewhat than the spacing of the projections 12 in the circumferential direction so that the inside 2 in the locked condition sits against the outer pane 1 under pre-tension. When the inner pane 2 remains in this pre-tensioned inserted condition for some time, a deformation occurs due to the flow characteristics of the plastic material, such that the inner pane 2 also attains a slightly spherical curvature.

To attain a sealed air cushion 13 between the inner pane 2 and the outer pane 1, a silicon seal 14 is sprayed onto the outside of the inner pane 2.

What is claimed is:

1. A visor for a helmet, particularly a motorcycle helmet, comprising an outer plastic pane and an inner plastic pane that are separably engaged and spaced apart relative to one another through a sealing edge with an air cushion therebetween, wherein the outer pane (1) is extruded of the plastic and has edge regions (7) projecting toward the inside in such a way that the inner pane (2), which is punched from a flat plate of plastic material, can be bent and inserted in a form-fitting manner within the outer pane (1);

wherein, thereafter, the inner, punched pane (2) sits separably engaged against the outer pane (1) in a pre-tensioned condition that arches the inner pane (2) within the outer pane;

wherein visor mounting and/or adjustment sections are extruded as one piece with the outer pane (1); and wherein the mounting and/or adjustment sections form catches (12) for the inner pane (2) which maintain-the inner pane in the bent pre-tensioned condition.

2. A visor according to claim 1, wherein the inner pane (2) sits, with outer edges (9) thereof, against the catches (12) on the inside of the outer pane (1) in such a way that the inner pane (2) is curved under generation of the pre-tension condition.

3. A visor according to claim 2, wherein the ends of the inner pane (2) encompass the catches (12) of the outer pane (1) at least partially in a form-fitting manner.

4. A visor according to claim 1, wherein the outer pane (1) is spherically curved forward.

5. A visor according to claim 1, wherein the inner pane (2) is tinted.

6. A visor according to claim 1, wherein the outer pane (1) is provided with a coating (4) on the outside that increases its scratch-resistance.

7. A visor according to claim 1, wherein the inner pane (2) is provided with an anti-condensation coating on the inside.

8. A visor according to claim 1, wherein a circumferential silicon seal (14) is provided on the side of the inner pane (2) that separably sits against the outer pane (1).

* * * * *